US006213889B1

(12) United States Patent
Hamburger

(10) Patent No.: US 6,213,889 B1
(45) Date of Patent: Apr. 10, 2001

(54) ADJUSTABLE GOLF CLUB PUTTER

(76) Inventor: Edward Hamburger, 4730 Morris Lake Cir., West Bloomfield, MI (US) 48323

( * ) Notice: Subject to any disclaimer, the term of this patent is extended or adjusted under 35 U.S.C. 154(b) by 0 days.

(21) Appl. No.: 09/235,454

(22) Filed: Jan. 22, 1999

Related U.S. Application Data

(60) Provisional application No. 60/093,320, filed on Jul. 20, 1998, and provisional application No. 60/072,187, filed on Jan. 22, 1998.

(51) Int. Cl.[7] ..... A63B 53/04

(52) U.S. Cl. ..... 473/245; 473/246; 473/248

(58) Field of Search ..... 473/244–248, 473/313, 340, 341, 307, 305

(56) References Cited

U.S. PATENT DOCUMENTS

| | | | |
|---|---|---|---|
| 782,955 | | 2/1905 | Emens . |
| 2,225,931 | * | 12/1940 | Sexton . |
| 2,932,515 | | 4/1960 | May . |
| 3,191,936 | | 6/1965 | Guier . |
| 3,206,206 | | 9/1965 | Santosuosso . |
| 3,333,854 | | 8/1967 | White . |
| 3,424,459 | | 1/1969 | Evancho . |
| 3,524,646 | | 8/1970 | Wheeler . |
| 3,829,092 | | 8/1974 | Arkin . |
| 3,848,737 | | 11/1974 | Kenon . |
| 3,891,212 | | 6/1975 | Hill . |
| 3,893,670 | | 7/1975 | Franchi . |
| 4,121,832 | | 10/1978 | Ebbing . |
| 4,253,666 | | 3/1981 | Murphy . |
| 4,340,227 | | 7/1982 | Dopkowski . |
| 4,506,888 | | 3/1985 | Nardozzi, Jr. . |
| 4,852,782 | | 8/1989 | Wu et al. . |
| 4,881,739 | | 11/1989 | Garcia . |
| 5,090,698 | * | 2/1992 | Kleinfelter . |
| 5,437,447 | | 8/1995 | Rigutto . |
| 5,597,362 | * | 1/1997 | Lee . |
| 5,616,087 | | 4/1997 | Bothwell . |
| 5,733,203 | * | 3/1998 | Middleton . |

* cited by examiner

*Primary Examiner*—Jeanette Chapman
*Assistant Examiner*—Stephen L. Blau
(74) *Attorney, Agent, or Firm*—MacMillan, Sobanski & Todd, LLC

(57) ABSTRACT

A golf club includes a head having a striking face and a shaft having first and second ends such that the shaft defines an axis. The club further includes a hosel assembly including a member having first and second ends. The first end of the member is fastened to the head. The hosel assembly also includes a hosel having first and second ends. The first end of the hosel is fastened to the shaft. The second end of the hosel is pivotally fastened to the second end of the member. A cam member is pivotally fastened to a first one of the hosel and the member about an axis. The cam member has a cam surface offset from the axis. The cam surface is engaged with a second one of the hosel and the member. The rotation of the cam member about the axis causes the cam surface to pivot the member relative to the hosel to change the lie or loft angle of the putter head relative to the shaft.

10 Claims, 9 Drawing Sheets

ADJUSTABLE GOLF CLUB PUTTER

CROSS REFERENCE TO RELATED APPLICATIONS

This application claims the benefit of U.S. Provisional Application No. 60/072,187 filed Jan. 22, 1998, and U.S. Provisional Application No. 60/093,320 filed Jul. 20, 1998.

BACKGROUND OF THE INVENTION

This invention relates in general to a golf club, and in particular to an improved golf club putter having a head which is adjustably mounted with respect to the shaft of the golf club.

Golf club putters generally include a shaft, a hand grip attached to one end of the shaft, and a putter head attached to the other end of the shaft. Commonly, hand grips include formations, such as a flattened area, formed thereon for proper positioning of a player's hands on the hand grip. The formations of the hand grip should be positioned correctly with respect to the putter head for accurate operation of the golf club putter. However, because of the varying grips, stances, and swings of different players, there is not one ideal shaft position which would accommodate every player. Also, the desired length of the shaft from the hand grip to the putter head differs from person to person.

In most golf club putters, the putter head is permanently attached to the shaft so that the axis of the shaft is at a predetermined lie angle. The lie angle is generally defined as the angle between the axis of the shaft and a plane defined by a bottom surface of the putter head in a direction towards or away from the player holding the golf club putter. However, due to differences in heights, stances, and swings of different players, there is not one ideal lie angle which would accommodate every player. Also, because the putter head is permanently attached to the shaft, the striking surface of the putter head is at a fixed loft angle. The loft angle is generally defined as the angle between the striking surface and the axis of the shaft. However, due to differences in heights, stances, and swings of different players, there is not one ideal loft angle which would accommodate every player. Also, it is sometimes desirable to adjust the orientation of the head of the putter relative to the shaft.

BRIEF SUMMARY OF THE INVENTION

This invention relates in general to an improved golf club which can be adjusted to change the loft angle or the lie angle between the shaft and the putter head of the golf club.

In one embodiment of the invention, the golf club includes a head having a striking face and a shaft having first and second ends such that the shaft defines an axis. The club further includes a hosel assembly including a member having first and second ends. The first end of the member is fastened to the head. The hosel assembly also includes a hosel having first and second ends. The first end of the hosel is fastened to the shaft. The second end of the hosel is pivotally fastened to the second end of the member. A cam member is pivotally fastened to a first one of the hosel and the member about an axis. The cam member has a cam surface offset from the axis. The cam surface is engaged with a second one of the hosel and the member. The rotation of the cam member about the axis causes the cam surface to pivot the member relative to the hosel to change the lie or loft angle of the putter head relative to the shaft.

Various objects and advantages of this invention will become apparent to those skilled in the art from the following detailed description of the preferred embodiment, when read in light of the accompanying drawings.

DETAILED DESCRIPTION OF THE INVENTION

Figure 1:
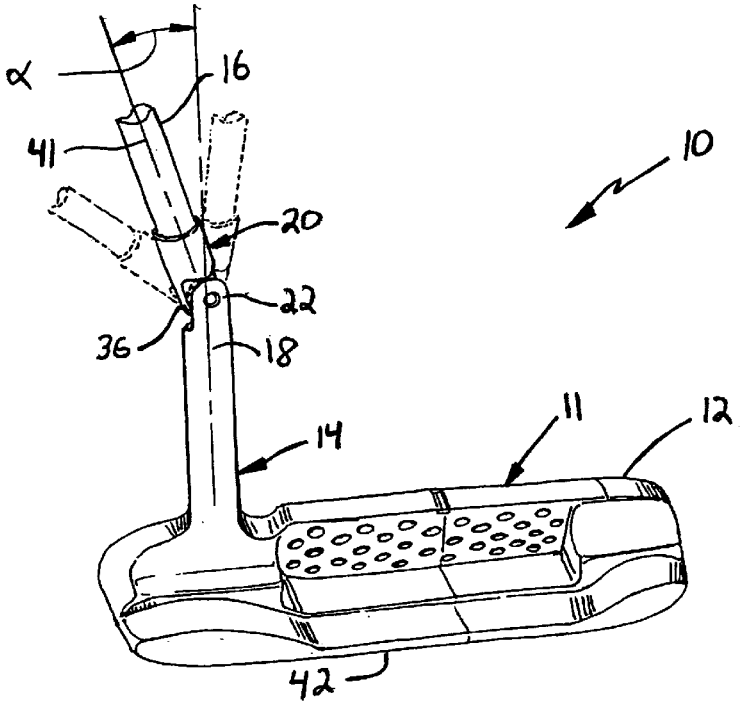
FIG. 1 is a perspective view of a first embodiment of a golf club putter, in accordance with the present invention.
Figure 2:
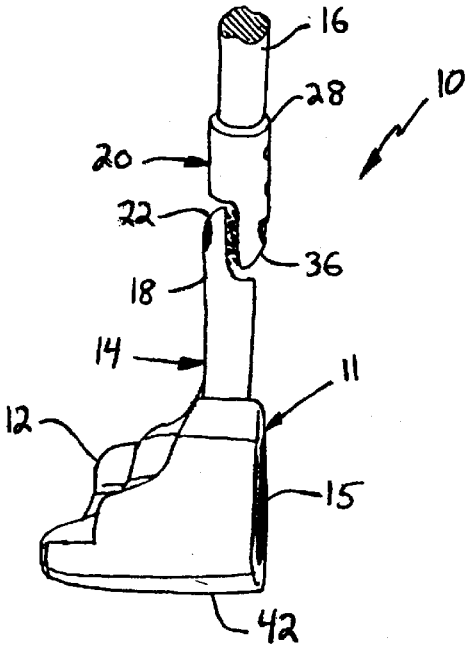
FIG. 2 is an elevational end view of the golf club putter of FIG. 1.
Figure 3:
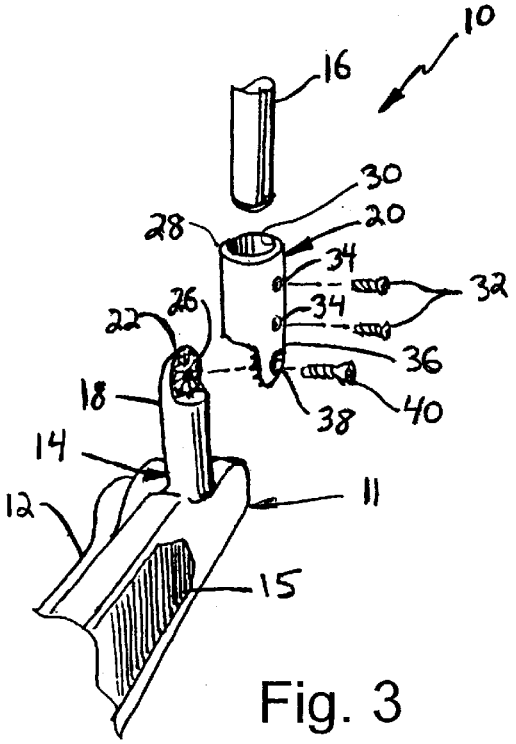
FIG. 3 is a partial exploded perspective view of the golf club putter of FIG. 1.

Referring now to the drawings, there is illustrated in FIGS. 1 through 3 a first embodiment of a golf club putter, indicated generally at 10, in accordance with the present invention. The putter 10 has a head 11 which generally includes a body 12 and a hosel extention member or a hosel 14 extending upward from an end of the body. Although the hosel 14 is shown as an integral portion of the body 12, the hosel 14 can be a separate structure fastened to the body 12. The body 12 has a striking face 15 for engagement with a golf ball (not shown) when the putter 10 is used. The body 12 and striking face 15 can have any desired shape suitable for striking a golf ball. As will be explained in detail below, the hosel 14 and the attachment member 20 define a hosel assembly for adjustably attaching the shaft 16 to the head 11.

An end 18 of the hosel 14 includes a notched portion 22 having a threaded bore 24 formed therethrough. The notched portion 22 also includes a circular engagement surface 26 preferably having a textured face, the reason for which will be explained in detail below.

The hosel or attachment member 20 includes a tubular portion 28 having a bore 30, as best shown in FIG. 3, which is formed therein. The bore 30 is adapted to receive the end of the shaft 16. The end of the shaft 16 is fixably attached to the attachment member 20 by a suitable fastener, such as by a pair of set screws 32 in threaded engagement with threaded bores 34 formed through the tubular portion 28 of the attachment member 20. The end of the shaft 16 can be fixably attached to the attachment member 20 by any suitable means, such as a band clamp assembly (not shown).

The end of the shaft 16 can be rotated to any desired rotational relationship with respect to the attachment member 20 prior to tightening of the set screws. For example, it is common for a shaft 16 to include a hand grip (not shown) having a flattened area for proper placement of the players hands. In the embodiment illustrated in FIGS. 1 through 3, the shaft 16 can be rotated prior to tightening the set screws so that the flattened area or the grip is at a desired rotational position relative to the head 10. The set screws 32 are then tightened to fixably attach the shaft 16 to the attachment member 20, and to the head 11 via the hosel 14.

Preferably, the end of the shaft 16 has a generally constant diameter for a predetermined length of the shaft 16. If the putter 10 of the present invention was provided with a shaft 16 having a relatively long length prior to attachment of the shaft 16 to the attachment member 20, the end of the shaft 16 can be cut to a desired length, and then attached to the attachment member 20 by tightening the set screws 32. Thus, the shaft 16 and the putter head 10 can be fastened together to accommodate the height, stance, and swing of virtually any player.

The attachment member 20 further includes a notched portion 36 having a bore 38 formed therethrough. The notched portion 36 also includes a circular engagement surface 38 engaged with the engagement surface 26 of the end 18 of the hosel 14. The engagement between the engagement surface 38 of the attachment member 20 and the engagement surface 26 of the hosel 14 helps prevent rotational movement therebetween. The attachment member 20 and the end 18 of the hosel 14 are pivotally fastened together by a screw 40 disposed in the bore 38 of the attachment member 20. The screw 40 is threadably engaged with the threaded bore 24 of the end 18 of the hosel 14. The attachment member 20 and the shaft 16 can be fixed at a desired angle a with respect to the hosel 14, as shown in FIG. 1. Since the hosel 14 is an integral structure of the body 12, the angle $\alpha$ is relative to an angle commonly referred to as the "lie angle". The lie angle is generally defined as an angle between an axis 41 of the shaft 16 and a plane generally defined by a bottom surface 42 of the body 12 in a direction towards or away from the player as the player holds the putter 10. Of course, the bottom surface 42 can have any suitable shape, such as a relatively flat shape or a curved shape. The attachment member 20 and the hosel 14 are preferably pivoted about a plane which is generally parallel to the axis of the shaft 16.

Figure 4:
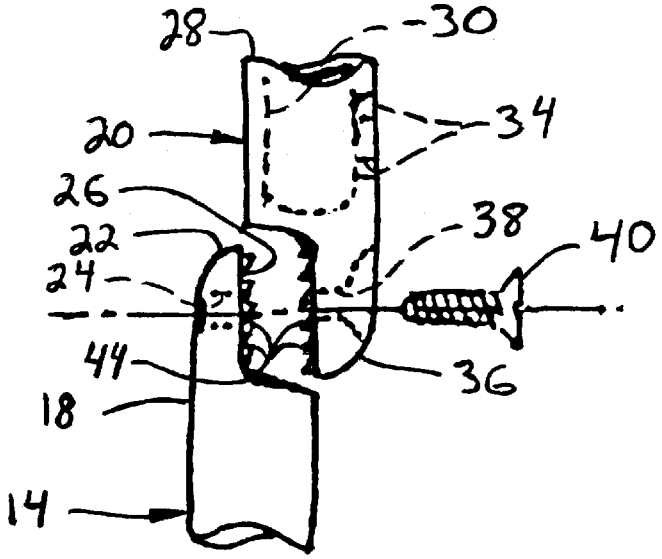
FIG. 4 is an enlarged partial exploded end view illustrating the adjustable hosel of the golf club putter of FIG. 1.
Figure 5:
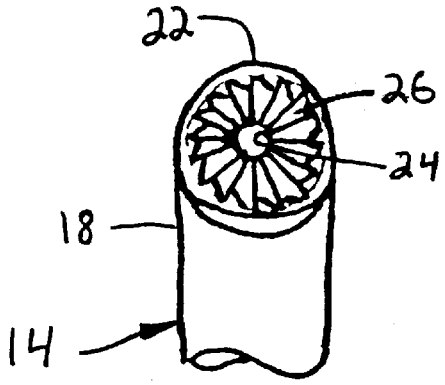
FIG. 5 is a partial elevational rear view of the upper end of the hosel of the golf club putter of FIG. 1.
Figure 6:
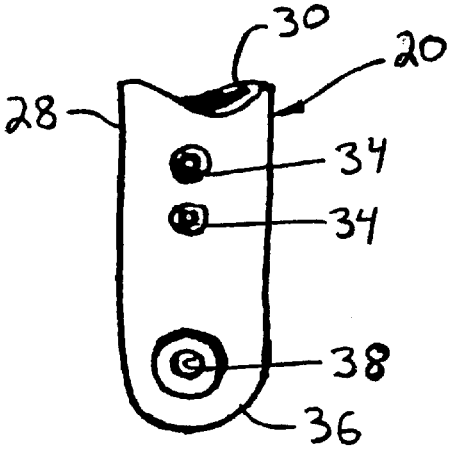
FIG. 6 is a partial elevational view of the shaft attachment member of the golf club putter of FIG. 1.

Preferably, the circular engagement surfaces 26 and 38 have a textured face to provide for a high coefficient of friction therebetween so that the surfaces 26 and 38 are less likely to slide or rotate relative to one another when the screw 40 is tightened. Alternatively, the circular engagement surfaces 26 and 38 can have interlocking grooves or teeth 44, as best shown in FIG. 4. The teeth 44 help prevent the head 10 from pivoting with respect to the shaft 16. The teeth 44 can be oriented in a radially extending manner so that the pitch or distance between adjacent teeth determines the incremental change of the lie angle.

Figure 7:
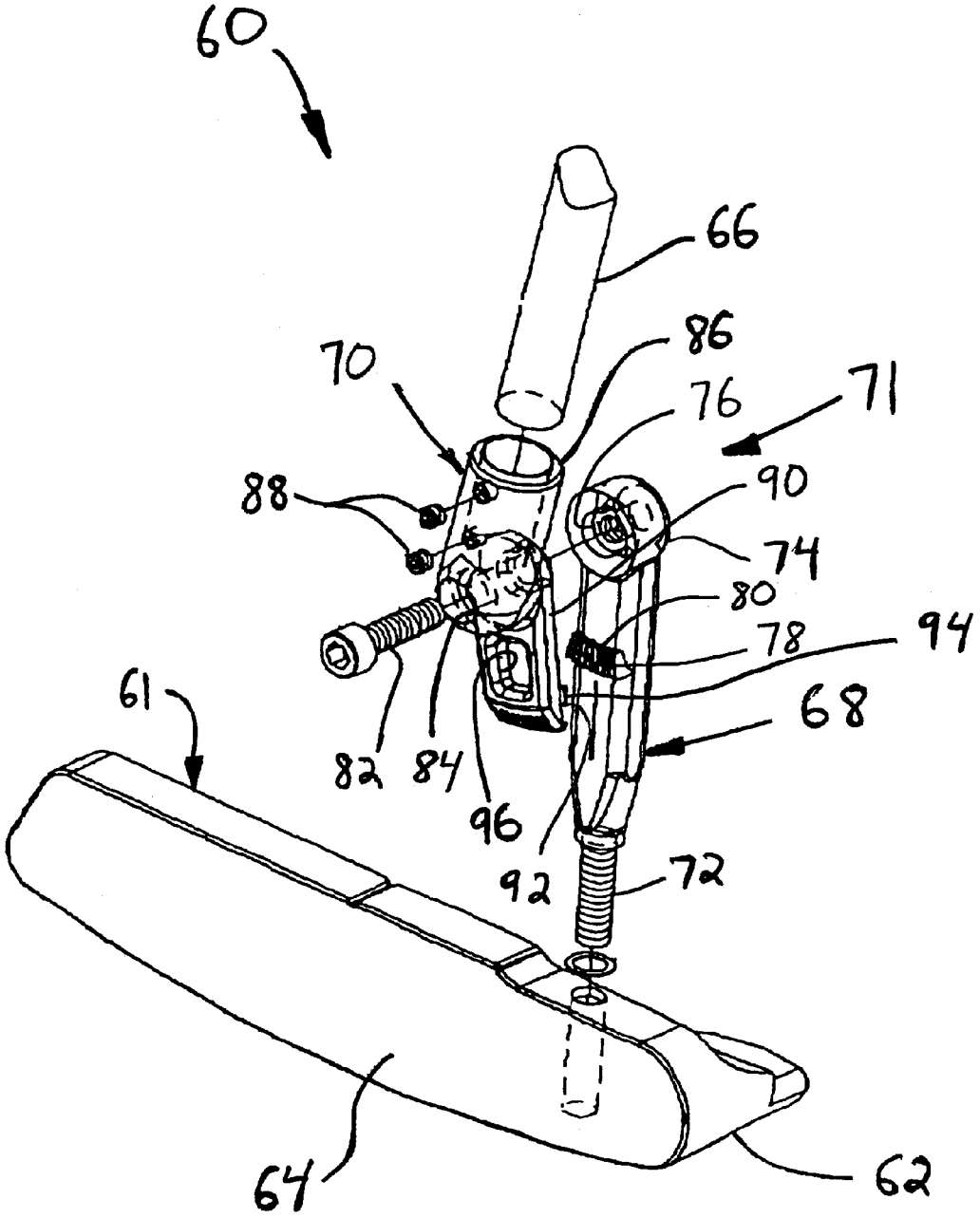
FIG. 7 is an exploded perspective view of a second embodiment of a golf club putter, in accordance with the present invention.

There is illustrated in FIG. 7 a second embodiment of a golf club putter, indicated generally at 60, in accordance with the present invention. The putter 60 has a head 61 including a body 62. The body 62 has a striking face 64. Of course, the body 62 and the striking face 64 can have any suitable shape. As will be described below, the body 62 is adjustably attached to a golf club shaft 66 by the cooperation of a hosel extention member or a hosel 68 and, a hosel or an attachment member 70 which define a hosel assembly, indicated generally at 71.

The hosel 68 has a first end 72 fixably attached to the body 62. The first end 72 can be fixably attached to the body 62 by any suitable method, such as by a press fit, a threaded connection, or a weld. The hosel 68 has a second end 74 having a threaded bore 76 formed therethrough. The hose 68 further includes an engagement surface 78 having a plurality of grooves 80 formed therein.

When the golf club putter 60 is assembled, the attachment member 70 is pivotally connected to the second end 74 of the hosel 68 by the cooperation of the threaded bore 76 and a bolt 82 disposed in a bore 84 formed through the attachment member 70. The shaft 66 is attached to a first arm 86 of the attachment member 70 by a pair of set screws 88, in a similar arrangement as the shaft 16 and attachment member 20 of the golf club putter head 10 illustrated in FIGS. 1 through 6. Of course, the shaft 66 of the putter 60 can be attached to the attachment member 70 by any suitable means. The attachment member 70 further includes a second arm 90 having an engagement surface 92. The engagement surface 92 faces the hosel 68. Preferably, the engagement surface 92 has a plurality of grooves 94 formed therein. The engagement surfaces 92 and 78 are engaged with one another and cooperate to maintain the selected lie angle between the head 64 and the shaft 66 when the bolt 82 is tightened. The second arm 90 may also include a cut-out window 96 formed therethrough for viewing and aligning indicia (not shown) representing the relative lie angle between the head 64 and the shaft 66.

Figure 9:
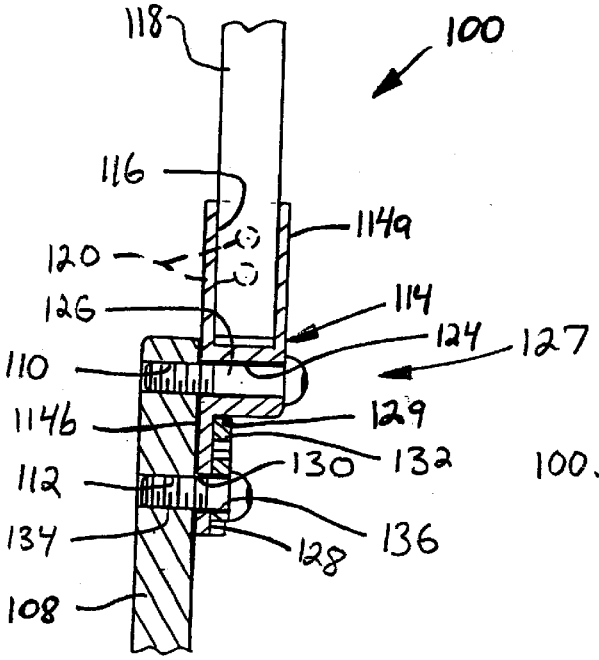
FIG. 9 is a partial sectional view of the golf club putter taken along Lines 9—9 in FIG. 8.
Figure 8:
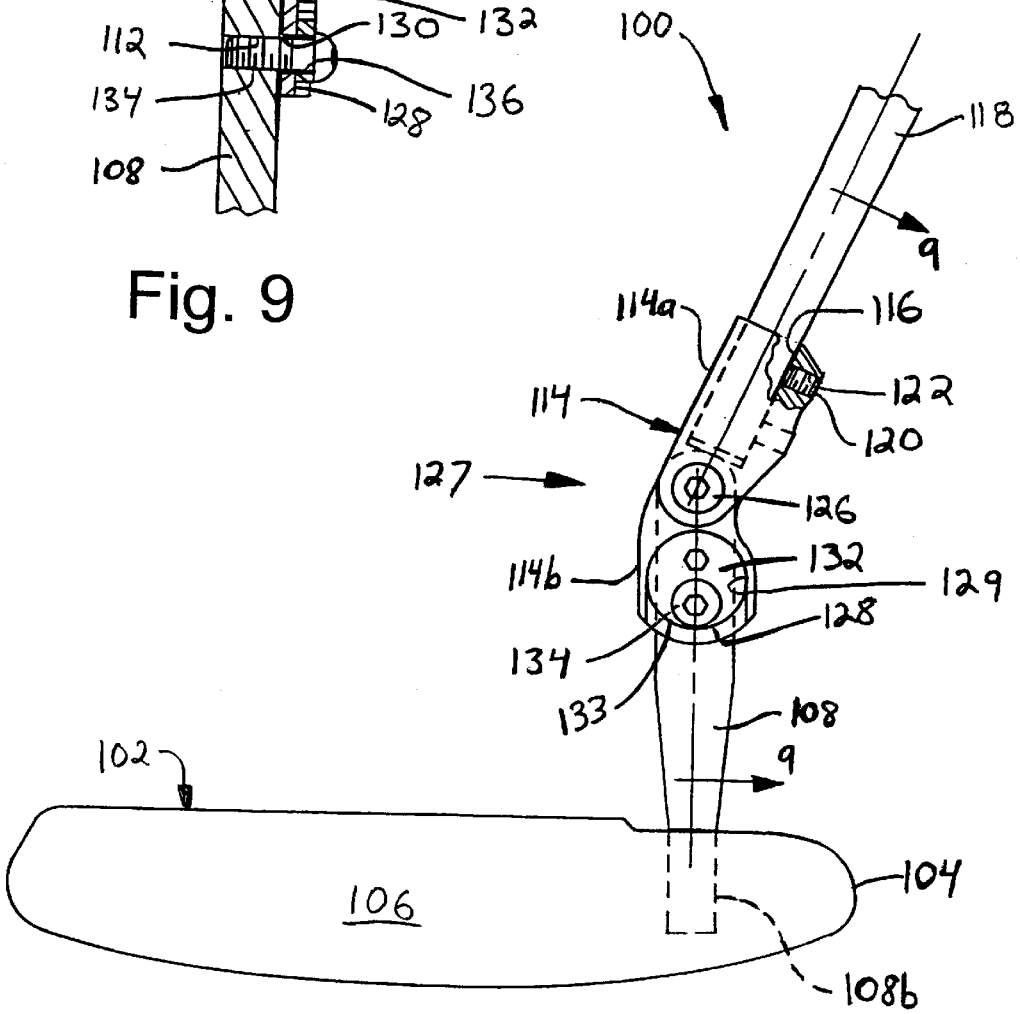
FIG. 8 is a front elevational view of a third embodiment of a golf club putter, in accordance with the present invention.
Figure 10:
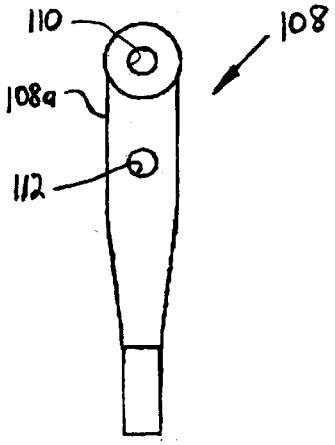
FIG. 10 is a front elevational view of the hosel of the golf club putter illustrated in FIG. 8.

There is illustrated in FIGS. 8 and 9 a third embodiment of a golf club putter, indicated generally at 100. The putter 100 has a head 102 having a body 104. The body 104 has a striking face 106 for engagement with a golf ball (not shown) when the putter 100 is used. The body 104 and striking face 106 can have any desired shape. A hosel extention member 108, also shown in FIG. 10, is fastened to and extends upwardly from the body 104. The hosel extention member 108 can be fastened to the body 104 by any suitable manner. As best shown in FIGS. 9 and 10, the hosel extention member extention member 108 has an upper end 108*a* having first and second threaded bores 110 and 112 formed therethrough.

Figure 11:
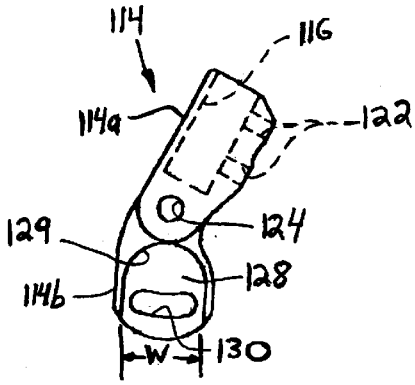
FIG. 11 is a front elevational view of the attachment member of the golf club putter illustrated in FIG. 8.

The putter 100 further includes a hosel or 114, which is also shown in FIG. 11. The, attachment member 114 has first and second arms 114*a* and 114*b*. The first arm 114*a* has a bore 116 formed therein for receiving the end of a shaft 118. The end of the shaft 118 is fixably attached to the hosel 114 by a suitable fastener, such as by a pair of set screws 120 in threaded engagement with threaded bores 122 formed through the first arm 114*a* of the hosel 114. The end of the shaft 118 can be fixably attached to the hosel 114 by any suitable means, such as a band clamp assembly (not shown). The shaft 118 can be rotated to any desirable position and cut to any desirable length in a similar manner as described above with respect to the putter 10 illustrated in FIG. 1. If desired, the shaft 118 can be permanently attached to the hosel 114.

The hosel 114 has a bore 124 formed therethrough located between the first and second arms 114*a* and 114*b*. The hosel 114 and the hosel extention member 108 are pivotally fastened together by a bolt 126 inserted in the bore 124 of the hosel 114 and the threaded bore 110 of the hosel extention member 108. Thus, the bores 110 and 124 and the bolt 126 define a pivot axis for rotation of the shaft 118 with respect to the hosel extention member 108. The hosel 108 and the hosel 114 define a hosel extention member assembly, indicated generally at 127 for adjustment of the shaft 118 relative to the head 102. Since the hosel extention member 108 is fastened to the body 104, rotation of the hosel 114 relative to the hosel extention member 108 changes the lie angle of the putter 100.

Figure 12:
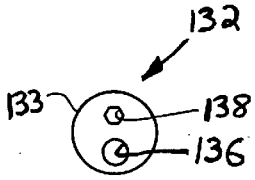
FIG. 12 is a front elevational view of the disk of the golf club putter illustrated in FIG. 8.

The second arm 114*b* has a semi-circular slot or recess 128 forming a generally U-shaped wall 129. The second arm 114*b* also has an arcuate slot 130 formed therethrough. A circular generally flat disk 132, also shown in FIG. 12, is disposed in the recess 128. The disk 132 has an outer cylindrical surface 133. The disk 132 is pivotally fastened to the hosel 114 by a bolt 134 which is inserted through a hole 136 formed through the disk 132, the arcuate slot 130 of the hosel 114, and threaded into the threaded bore 112 of the hosel extention member 108. The hole 136 is positioned off-center with respect to the center of the disk 132. When properly tightened, the cooperation of the bolt 134, the disk 132, and the hosel 114 frictionally prevents the hosel 114 from rotating relative to the hosel extention member 108.

Figure 13:
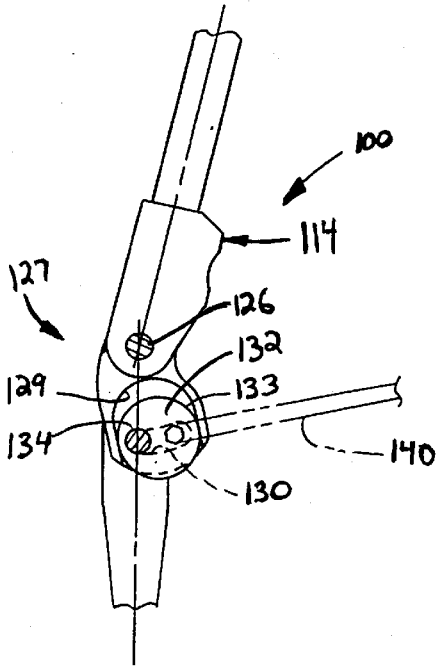
FIG. 13 is a front elevational view of the golf club putter of FIG. 8 oriented in an alternate lie angle position.
Figure 14:
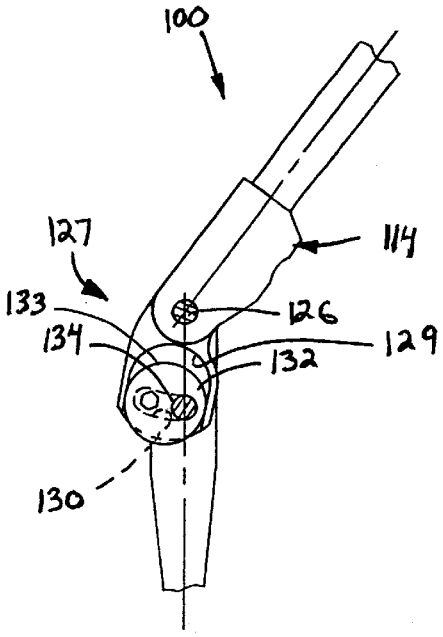
FIG. 14 is a front elevational view of the golf club putter of FIG. 8 oriented in an alternate lie angle position.

To adjust the lie angle, the bolt 134 is loosened so that the disk 132 can be rotated. Preferably, the diameter of the disk 132 is just slightly smaller than a width W, as shown in FIG. 11, of the recess 128 so that the disk 132 can travel in a generally vertical direction, as viewing FIG. 8, within the recess 128. Rotation of the disk 132 causes the bolt 134 to move within in an arcuate path within the arcuate slot 130, thereby adjusting the lie angle. The hosel 114 rotates relative to the hosel extention member 108 about a pivot point defined by the bolt 126. Since the hole 136 and the bolt 134 are off-center with respect to the center of the disk 132, and the disk 132 is confined in the recess 128, the rotation of the disk 132 functions as a cam member such that a portion of the outer cylindrical surface 132 of the disk 132 engages and pushes against a portion of the wall 129. The outer cylindrical surface 133 functions as a cam surface acting against the wall 129. The outer cylindrical surface of the bolt 134 also functions as a cam surface acting against the inner wall of the arcuate slot 130. Thus, the rotation of the disk 132 changes the angular relationship between the hosel extention member 108 and the hosel 114. For example, rotation of the disk 132 in a clockwise direction form the position shown in FIG. 8, causes the bolt 134 to move leftwardly, as viewing FIG. 8, within the arcuate slot 130, causing the disk 132 to move generally downwardly to a position shown in FIG. 13. Since the bolt 134 is fixed relative to the hosel extention member 108, except rotationally within the bore 112, movement of the disk 132 causes movement of the hosel 114, thereby adjusting the lie angle. If the disk 132 was rotated counter-clockwise, as viewing FIG. 8, the hosel 114 would be moved to a position illustrated in FIG. 14. After the disk 132 has been properly rotated, the bolt 126 can then be tightened, thereby frictionally fixing the hosel extention member 108 relative to the hosel 114.

The disk 132 can be rotated by any suitable mechanism. For example, the disk 132 can have a non-cylindrical bore 138 formed therein for receiving a lever arm 140 to assist in rotating the disk. For example, the bore 138 could have a hexagonal shape. Appropriate movement or rotation of the lever arm 140, causes rotation of the disk 132. Preferably, the bore 138 and the openings formed in the heads of the bolts 126 and 134 have the same size and non-cylindrical shape, so that a common lever arm 140 can be used to manipulate them.

Although the hosel 114 is shown and described as being attached to the shaft 118, and the hosel extention member 108 is shown and described as being attached to the head 102, the hosel 114 and hosel extention member 108 can be interchanged. For example, the hosel 114 could be adapted to be fastened to the head 102, and the hosel extention member 108 could be adapted to be fastened to the shaft 118.

Figure 15:
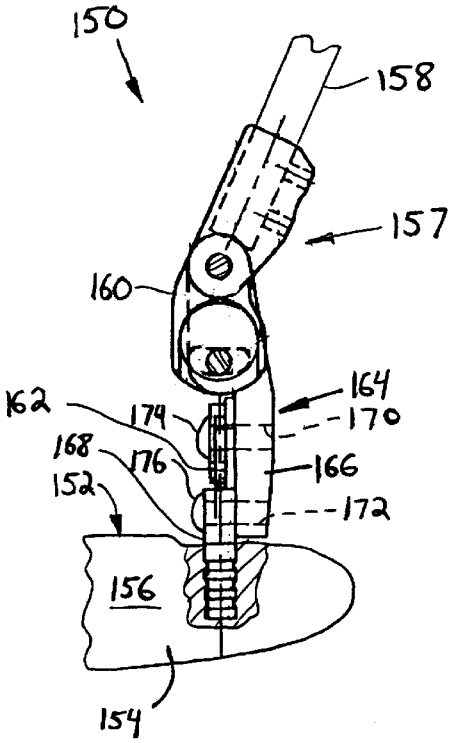
FIG. 15 is a front elevational view of a fourth embodiment of a golf club putter, in accordance with the present invention.
Figure 16:
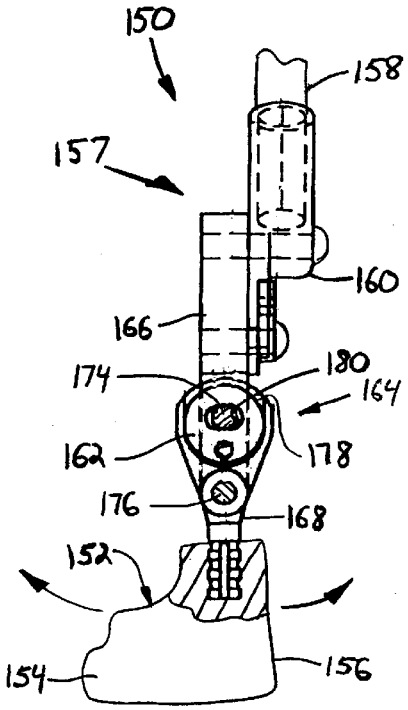
FIG. 16 is a side elevational view of the golf club putter illustrated in FIG. 15.

There is illustrated in FIGS. 15 and 16 a fourth embodiment of a golf club putter, indicated generally at 150. The putter 150 has a head 152 having a body 154 and a striking face 156. The putter 150 has a first hosel assembly, indicated generally at 157, similar to the hosel assembly 127 of the putter 100 of FIG. 8. A shaft 158 is fastened to hosel 160 in a similar manner as the putter 100 illustrated in FIGS. 8 and 9. The hosel 160 and a circular disk 162 which provides means for changing the lie angle, as described above with respect to the putter 100.

The putter 150 further includes a second hosel assembly, indicated generally at 164, which is attached to the hosel assembly 157. The second hosel assembly 164 can adjustably change the angle between the striking face 156 and the shaft 158 in a transverse direction to the player holding the putter 150, commonly referred to as the "loft angle". Preferably, the second hosel assembly 164 is pivoted in a plane which is generally perpendicular to a second plane generally defined by the striking face 156 of the head 152. The loft angle is changed by rotating the head 152 about a pivot point defined by a bolt 176. As stated above, the second hosel assembly 164 is similar in structure and function as the hosel assembly 127 of the putter 100 of FIG. 8. However, the orientation of the second hosel assembly 164 is offset by 90 degrees, compared to the first hosel assembly 157. The second hosel assembly 164 includes a first portion 166 adjustably fastened to the hosel 160, and a second portion 168 fastened to the body 154. The first portion 166 has a pair of threaded bores 170 and 172 for receiving a bolt 174 and the bolt 176, respectively. The second portion 168 includes a recess 178 and an arcuate slot 180 formed therethrough. The second hosel assembly 164 operates in a similar manner as described above with respect to the hosel assembly 127 of the putter 100.

Figure 17:
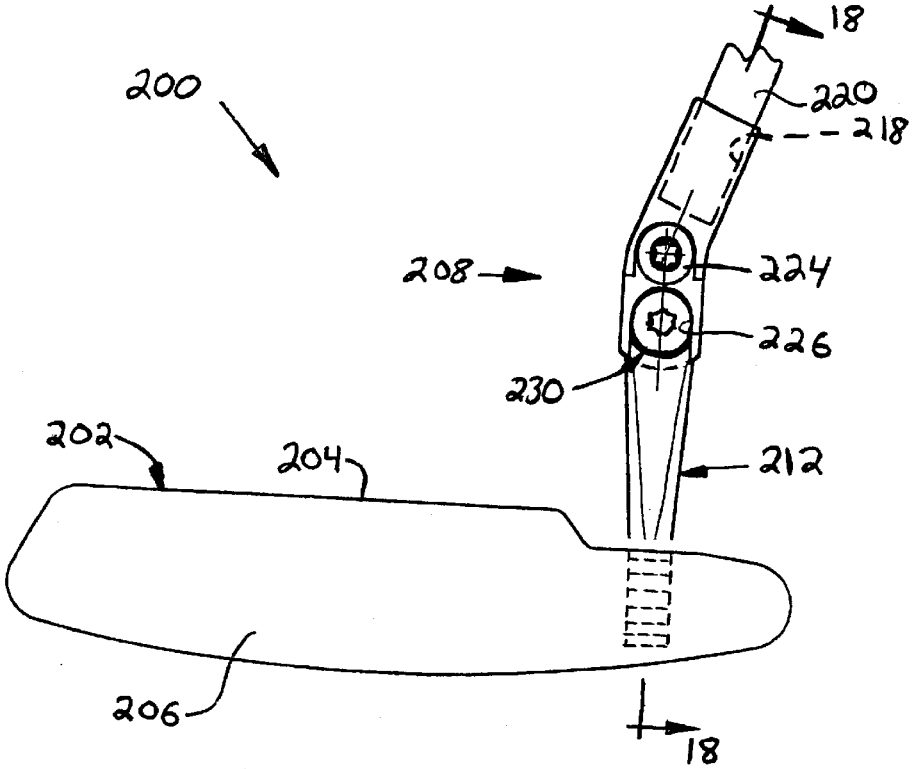
FIG. 17 is a front elevational view of a fifth embodiment of a golf club putter, in accordance with the present invention.
Figure 18:
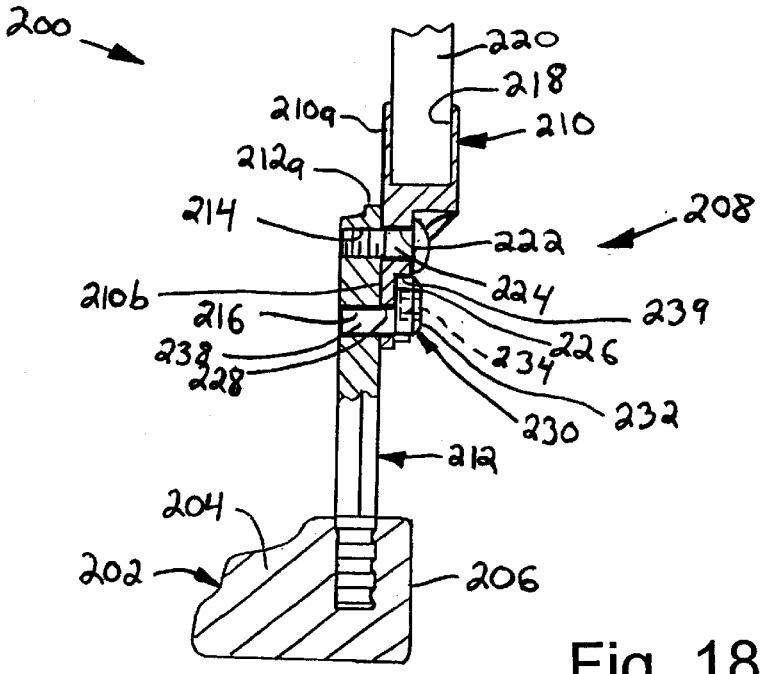
FIG. 18 is a partial sectional view of the golf club putter taken along Lines 18—18 in FIG. 17.
Figure 19:
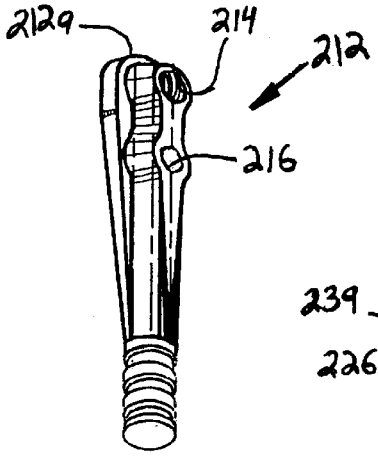
FIG. 19 is a perspective view of the hosel of the golf club putter illustrated in FIG. 17.

There is illustrated in FIGS. 17 and 18 a fifth embodiment of a golf club putter, indicated generally at 200. The putter 200 has a head 202 having a body 204. The body 204 has a striking face 206 for engagement with a golf ball (not shown) when the putter 200 is used. The body 204 and striking face 206 can have any desired shape. The putter 200 further includes a hosel assembly, indicated generally at 208. The hosel assembly 208 includes an hosel 210 and a hosel extention member 212. The hosel extention member 212, which is also shown in FIG. 19, is fastened to and extends upwardly from the body 204. The hosel extention member 212 can be fastened to the body 204 by any suitable manner. As best shown in FIGS. 18 and 19, the hosel extention member 212 has an upper end 212*a* having first and second bores 214 and 216 formed therethrough. Preferably, the bore 214 is internally threaded, and the bore 216 has a relatively smooth surface.

Figure 20:
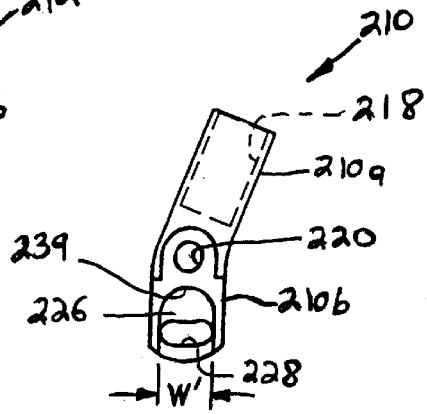
FIG. 20 is a front elevational view of the attachment member of the golf club putter illustrated in FIG. 17.

The hosel 210, which is also shown in FIG. 20, has first and second arms 210*a* and 210*b* extending at an angle to one another. The first arm 210*a* has a bore 218 formed therein for receiving the end of a shaft 220. The end of the shaft 220 can be attached to the hosel 210 by any suitable manner, such as for example, a press-fit or permanently adhered thereto. If desired, the shaft 220 can be adjustably attached to the hosel 210 by fasteners, such as by a pair of set screws (not shown) or by a band clamp assembly (not shown).

The hosel 210 has a bore 222 formed therethrough located between the first and second arms 210*a* and 210*b*. The hosel 210 and the hosel extention member 212 are pivotally fastened together by a bolt 224 inserted in the bore 222 of the hosel 210 and threaded into the bore 214 of the hosel extention member 212. Thus, the bores 214 and 222 and the bolt 224 define a pivot axis for rotation of the shaft 220 with respect to the hosel extention member 212. The hosel extention member 212 and the hosel 210 of the hosel assembly 208 provide for adjustment of the shaft 220 relative to the head 202. Since the hosel extention member 212 is fastened to the body 204, rotation of the hosel 210 relative to the hosel extention member 212 changes the lie angle of the putter 200.

Figure 21:
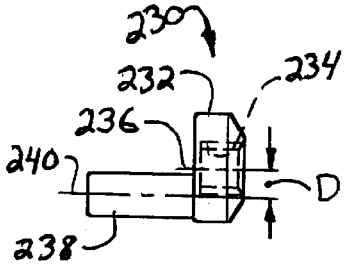
FIG. 21 is an enlarged front elevational view of the cam member of the golf club putter illustrated in FIG. 17.

The second arm 210*b* of the hosel 210 has a semicircular recess 226 and an arcuate slot 228 formed therethrough. A cam member 230, which is also shown in FIG. 21, is disposed in the arcuate slot 228 and the recess 226. The cam member 230 includes a cylindrical portion or head 232 having a slot 234 defining an axis 236. The slot 234 can be any suitable shape for receiving a tool (not shown) to assist in rotating the cam member. For example, the slot 234 can have a six-sided star shaped cross-section for receiving a conventional "torx" type wrench (not shown). Of course, the slot 234 can have any suitable cross-sectional shape. The cam member 230 further includes a cylindrically shaped arm 238 extending from the head 232. The arm 238 extends along an axis 240 which is preferably parallel to but offset from the axis 236 by a distance "D", as shown in FIG. 21, the reason for which will be explained below. The arm 238 extends into the bore 216 of the hosel extention member 212, as best shown in FIG. 18. The head 232 of the cam member 230 is disposed in the recess 226 of the hosel 210. The outer cylindrical surface of the head 232 engages a U-shaped wall 239 defined by the recess 226.

Figure 22:
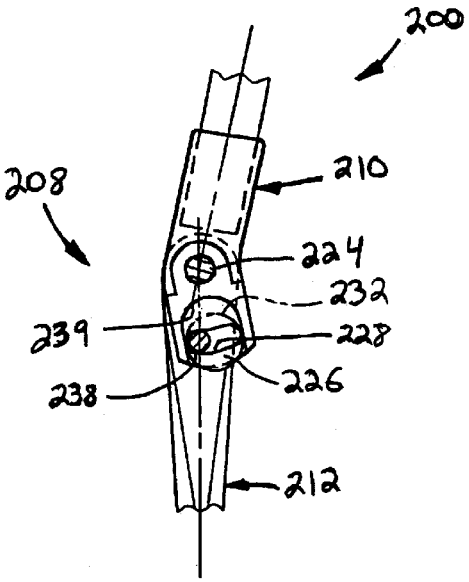
FIG. 22 is a front elevational view of the golf club putter of FIG. 17 oriented in an alternate lie angle position.
Figure 23:
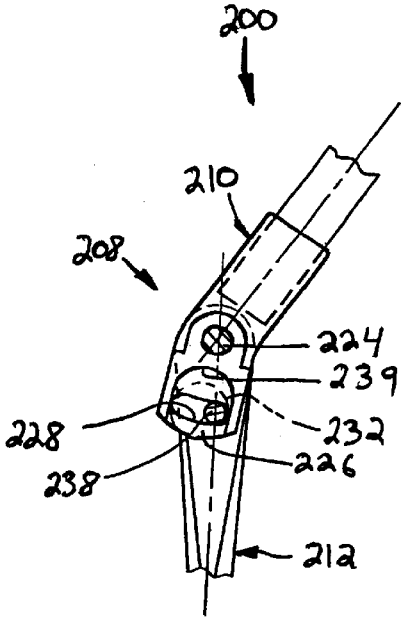
FIG. 23 is a front elevational view of the golf club putter of FIG. 17 oriented in an alternate lie angle position.

To adjust the lie angle of the putter 200, the bolt 224 is loosened so that the hosel extention member 212 is not frictionally fastened to the hosel 210. Unloosening of the bolt 224 also allows the cam member 230 to be freely rotated. Preferably, the diameter of the head 232 of the cam member 230 is just slightly smaller than a width W', as shown in FIG. 20, of the recess 226 of the hosel 210. The head 232 of the cam member 230 functions similarly to the disk 132 of the putter 100 illustrated in FIG. 8. Rotation of the head 232 of the cam member 230 about the axis 236 causes the arm 238 to move within in an arcuate path within the arcuate slot 228 of the hosel 210, thereby adjusting the lie angle. The hosel 210 rotates relative to the hosel extention member 212 about a pivot point defined by the bolt 224. Since the axis 240 of the arm 238 is off-center with respect to the axis 236 of the head 232, and the head 232 is confined in the recess 226, the rotation of the cam member 230 functions as a cam, the rotation of which changes the angular relationship between the hose extention member 212 and the hosel 210. For example, rotation of the cam member 230 in a clockwise direction form the position shown in FIG. 17, causes the bolt arm 238 to move leftwardly, as viewing FIG. 17, within the arcuate slot 228, causing the cam member 230 to move downwardly within the recess 226 to a position shown in FIG. 22. Since the arm 238 is fixed relative to the hosel extention member 212, except rotationally within the bore 216, movement of the cam member 230 causes movement of the hosel 210, thereby adjusting the lie angle of the putter 200. If the cam member 230 was rotated counterclockwise, as viewing FIG. 17, the hosel 210 would be moved to a position illustrated in FIG. 23. After the cam member 230 has been properly rotated to achieve the desired lie angle, the bolt 224 can than be tightened, thereby frictionally fixing the hosel 212 relative to the hosel 210.

Figure 24:
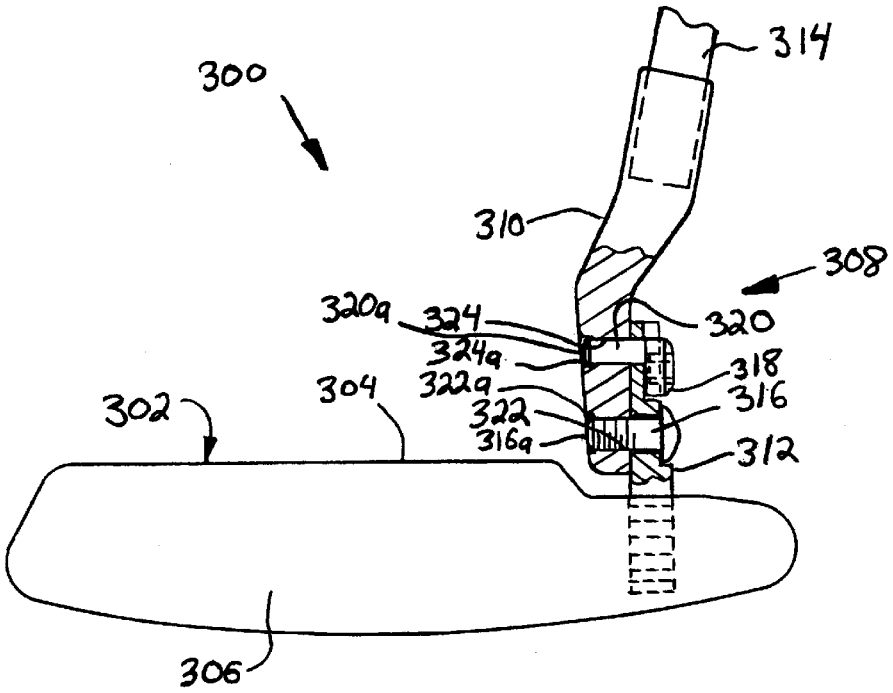
FIG. 24 is a front elevational view of a sixth embodiment of a golf club putter, in accordance with the present invention.
Figure 25:
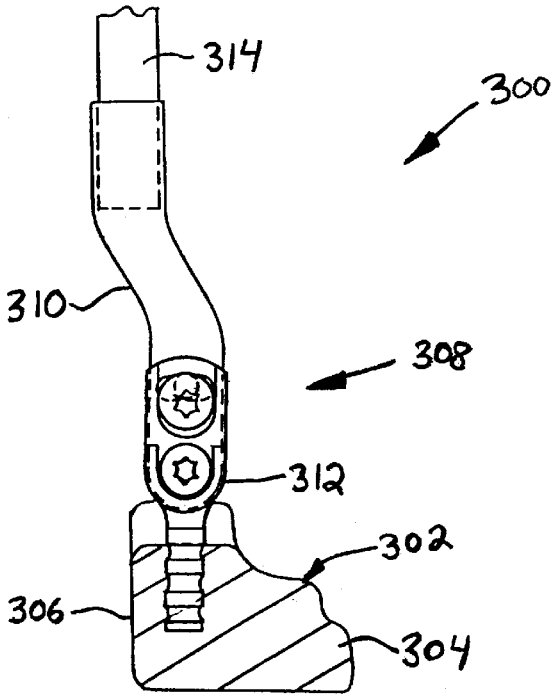
FIG. 25 is a side view, shown partially in section, of the golf club putter illustrated in FIG. 24.

There is illustrated in FIGS. 24 and 25 a sixth embodiment of a golf club putter, indicated generally at 300. The putter 300 has a head 302 having a body 304 and a striking face 306. The putter 300 has a hosel assembly, indicated generally at 308, similar in structure and function as the hosel assembly 208 of the putter 200 of FIG. 17. The hosel assembly 308 includes an attachment member 310 and a hosel 312. A shaft 314 is fastened to the attachment member 310. The hosel assembly 308 provides means for adjustably changing the loft angle of the putter 300, i.e., the angle between the striking face 306 and the shaft 314 in a transverse direction to the player holding the putter 300. As stated above, the hosel assembly 308 is similar in structure and function as the hosel assembly 208 of the putter 200 of FIG. 17, except that the plane of rotation is offset by 90 degrees.

As shown in FIG. 24, the hosel assembly 308 includes a bolt 316 and a cam member 318 having an generally cylindrical arm 320 extending from the cam member 318. The bolt 316 is threadably engaged with a threaded bore 322 formed in the attachment member 310. The arm 320 is disposed in a bore 324 formed in the attachment member 310. The bolt 316 and the arm 320 are similar in structure and function as the bolt 224 and the arm 238, respectively, of the hosel assembly 208 of the putter 200 illustrated in FIG. 18. To retain the bolt 316 and the arm 320 in the bores 322 and 324, respectively, the bolt 316 and the arm 320 preferably have ends 316*a* and 320*a*,respectively, which are "peened" or capped so that they are prevented from substantially moving in a rightward direction, as viewing FIG. 24. The ends 316*a* and 320*a* have radially outwardly extending portions which are trapped by shoulders 322*a* and 324*a* formed in the bores 322 and 324, respectively.

It should be understood that all of the embodiments of the putters described throughout this specification, can be configured differently to include or exclude features which are described and shown with other embodiments. For example, the putter 300 of FIG. 24 can be configured to further include the hosel assembly 208 of the putter 200 of FIG. 17.

It should also be understood that although the above described embodiments are illustrated and described as golf club putters, the present invention relates to any suitable golf club structure suitable for striking a ball, such as for example, "drivers", "woods", "irons", and "wedges".

In accordance with the provisions of the patent statutes, the principle and mode of operation of this invention have been explained and illustrated in its preferred embodiment. However, it must be understood that this invention may be practiced otherwise than as specifically explained and illustrated without departing from its spirit or scope.

What is claimed is:

1. A hosel assembly for a golf club having a shaft and a head, the hosel assembly comprising:

a member having first and second ends, said first end of said member being fastened to the head;

a hosel having first and second ends, said first end of said hosel fastened to the shaft, said second end of said hosel being pivotally fastened to said second end of said member; and a cam member pivotally fastened to a first one of said hosel and said member about an axis, said cam member having a cam surface offset from said axis, said cam surface being engaged with a second one of said hosel and said member, wherein rotation of said cam member about said axis causes said cam surface to pivot said member relative to said hosel.

2. The hosel assembly of claim 1, wherein said cam surface is a generally cylindrical portion disposed within a recess formed in said second one of said hosel and said member defining a wall engaged with said cylindrical portion during rotation of said cam member.

3. The hosel assembly of claim 2, wherein said cam member has a cylindrical portion disposed in said recess, said cam member further including an arm extending from said cylindrical portion and disposed in a bore formed in said first one of said hosel and said member.

4. The hosel assembly of claim 1, wherein said cam member is pivotally fastened to said member, and said cam surface is engaged with said hosel.

5. The hosel assembly of claim 1, wherein rotation of said cam member about said axis causes said cam surface to pivot said member relative to said hosel to change the lie angle of the head.

6. A golf club comprising:

a shaft having first and second ends;

a head having a striking face; and a hosel assembly including;

a member having first and second ends, said first end of said member being fastened to the head;

a hosel having first and second ends, said first end of said hosel fastened to the shaft, said second end of said hosel being pivotally fastened to said second end of said member; and a cam member pivotally fastened to a first one of said hosel and said member about an axis, said cam member having a cam surface offset from said axis, said cam surface being engaged with a second one of said hosel and said member, wherein rotation of said cam member about said axis causes said cam surface to pivot said member relative to said hosel.

7. The golf club of claim 6, wherein said cam surface is a generally cylindrical portion disposed within a recess formed in said second one of said hosel and said member defining a wall engaged with said cylindrical portion during rotation of said cam member.

8. The golf club of claim 7, wherein said cam member has a cylindrical portion disposed in said recess, said cam member further including an arm extending from said cylindrical portion and disposed in a bore formed in said first one of said hosel and said member.

9. The golf club of claim 6, wherein said cam member is pivotally fastened to said member, and said cam surface is engaged with said hosel.

10. The golf club of claim 6, wherein rotation of said cam member about said axis causes said cam surface to pivot said member relative to said hosel to change the lie angle of the head.

* * * * *